US005975368A

United States Patent [19]

Wood

[11] Patent Number: 5,975,368

[45] Date of Patent: Nov. 2, 1999

[54] BI-MODAL DISPENSING SYSTEM FOR PARTICULATE MATERIAL

[75] Inventor: Christopher J. Wood, Greenfield, Wis.

[73] Assignee: AptarGroup, Inc., Crystal Lake, Ill.

[21] Appl. No.: 09/019,056

[22] Filed: Feb. 5, 1998

[51] Int. Cl.[6] ..... B67D 1/08

[52] U.S. Cl. ..... 222/151; 222/565; 222/480

[58] Field of Search ..... 222/480, 487, 222/565, 546, 498, 543, 150

[56] References Cited

U.S. PATENT DOCUMENTS

| | | | |
|---|---|---|---|
| D. 276,981 | 1/1985 | Cleevely . | |
| 2,625,306 | 1/1953 | Murphy | 222/543 |
| 2,695,732 | 11/1954 | Tupper . | |
| 2,826,343 | 3/1958 | Albiani | 222/498 |
| 3,018,024 | 1/1962 | Foord | 222/565 |
| 3,254,811 | 6/1966 | Harris | 222/565 |
| 3,424,351 | 1/1969 | Cilluffo et al. | 222/565 |
| 3,529,752 | 9/1970 | Nyquist | 222/487 |
| 4,106,672 | 8/1978 | Tecco et al. | 222/546 |
| 4,284,200 | 8/1981 | Bush et al. . | |
| 4,369,901 | 1/1983 | Hidding . | |
| 4,408,703 | 10/1983 | Libit . | |
| 4,548,331 | 10/1985 | Montgomery . | |
| 4,693,399 | 9/1987 | Hickman et al. . | |
| 4,723,693 | 2/1988 | DeCoster . | |
| 4,759,478 | 7/1988 | Richardson et al. . | |
| 4,828,130 | 5/1989 | Hofmann . | |
| 5,022,566 | 6/1991 | Song et al. . | |
| 5,183,171 | 2/1993 | Pherigo | 222/565 |
| 5,330,082 | 7/1994 | Forsyth . | |
| 5,513,776 | 5/1996 | Canini . | |
| 5,551,608 | 9/1996 | Moore et al. | 222/565 |
| 5,697,533 | 12/1997 | Shahbazian . | |

*Primary Examiner*—Andres Kashnikow
*Assistant Examiner*—Dinh Q. Nguyen
*Attorney, Agent, or Firm*—Rockey, Milnamow & Katz, Ltd.

[57] ABSTRACT

A dispensing structure is provided for a container that has an opening from which a product can be dispensed. The structure includes a body for extending around the container opening. A foraminous member is provided with a plurality of dispensing holes and is movable between a closed position and an open position. A lid is provided for sealingly occluding the foraminous member and for moving between a closed position and an open position.

19 Claims, 2 Drawing Sheets

FIG. 5
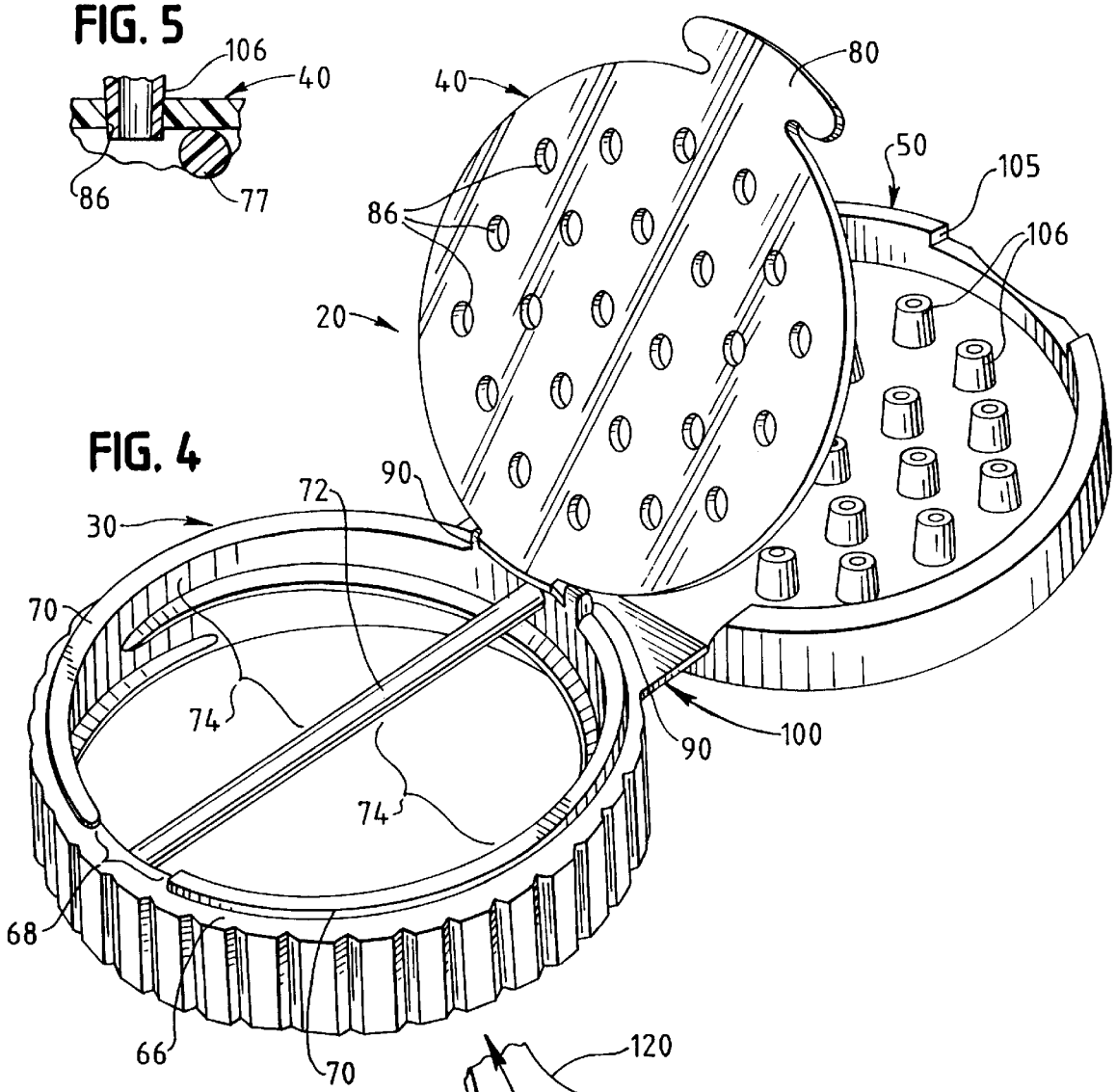
FIG. 4
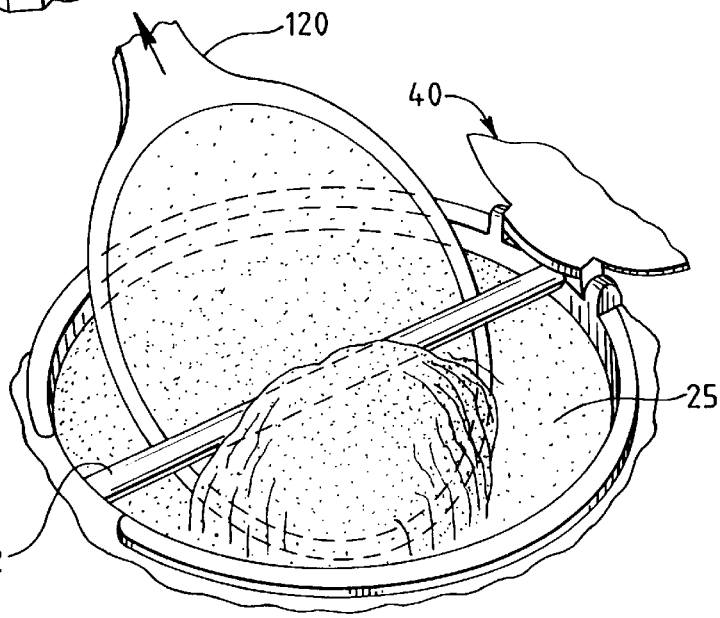
FIG. 6

BI-MODAL DISPENSING SYSTEM FOR PARTICULATE MATERIAL

TECHNICAL FIELD

This invention relates to a system for dispensing product from a container. The invention is more particularly related to a system that facilitates removal of a particulate product, such as a spice, from a container by pouring or sprinkling or with a spoon.

BACKGROUND OF THE INVENTION AND TECHNICAL PROBLEMS POSED BY THE PRIOR ART

A variety of packages, including dispensing packages or containers, have been developed for particulate food products, such as herbs, spices, granular salt, etc., as well as other materials. Such containers typically have an open upper end on which is mounted a closure.

One type of dispensing closure for dispensing containers typically includes many small dispensing holes. When the user inverts and shakes the container, the product particles are sprinkled out through the holes.

Another type of container closure may have one large opening into which a spoon can be inserted to scoop out a quantity of the product.

Some containers are provided with a closure which has (1) one large opening through which material can be poured or removed with a spoon, and (2) a plurality of small sprinkling apertures adjacent the large aperture. Both the large aperture and the small sprinkling apertures can be closed with separate lids.

While the above-described container closures function generally satisfactorily, it would be desirable to provide an improved dispensing structure for containers. In particular, it would be desirable to provide a dispensing structure wherein substantially the entire open end of the container could be used for sprinkling of the product from within the container. However, it would also be desirable to provide such a dispensing structure with the capability for permitting the same open end of the container to be substantially completely unobstructed so as to accommodate either pouring of the container contents or removal of the container contents with a spoon.

It would also be advantageous if such an improved dispensing structure could include a system for facilitating the leveling of a product in a spoon as the spoon is removed from the container.

Further, it would be desirable if such an improved dispensing structure could accommodate a sealing lid system which would function to preserve the freshness of the product in the container when the dispensing structure is in a closed condition.

It would also be beneficial if such an improved dispensing structure could accommodate use of a variety of different materials. Further, it would be desirable if such an improved dispensing structure could be provided with a design that would accommodate efficient, high-quality, large volume manufacturing techniques with a reduced product reject rate.

The present invention provides an improved dispensing structure which can accommodate designs having the above-discussed benefits and features.

SUMMARY OF THE INVENTION

According to one aspect of the present invention, a dispensing system or structure is provided for a container that has an opening to the container interior. The dispensing structure includes a body for extending around the container opening. The body defines a support surface. The structure further includes a foraminous member defining a plurality of dispensing holes. A first hinge connects the foraminous member to the body. The first hinge accommodates movement of the foraminous member between (1) a closed position supported on the body support surface over the container opening for facilitating sprinkling of a product from the container, and (2) an open position away from the closed position to permit access to the container interior.

The structure also includes a lid with a plurality of protrusions that each correspond to, and are adapted to sealingly occlude, one of the foraminous member holes. A second hinge connects the lid to the body. The second hinge accommodates movement of the lid between (1) a closed position over both the container opening and the foraminous member when the foraminous member is in its closed position whereby the protrusions are received in the corresponding foraminous member holes to sealingly occlude the holes, and (2) an open position away from the lid closed position to permit lifting of the foraminous member. When the foraminous member is lifted, the container can be inverted to pour out the contents. Alternatively, the container may be maintained in an upright orientation, and a spoon can be used for removing some or all of the contents.

According to yet another aspect of the invention, a dispensing structure is provided for a container having an opening from which a product can be dispensed through the dispensing structure. The dispensing structure includes a body for extending around the container opening.

The dispensing structure also includes a foraminous member that defines a plurality of dispensing holes. The foraminous member is movable between (1) a closed position over the container opening for facilitating sprinkling of a product from the container, and (2) an open position away from the closed position to permit access to the container interior.

The dispensing structure further includes a lid. The lid is movable between (1) a closed position over both the container opening and the foraminous member when the foraminous member is in its closed position whereby the holes of the foraminous member are sealingly occluded, and (2) an open position away from the lid closed position to permit access to the foraminous member.

In a preferred embodiment, the dispensing structure is provided as a separate closure which is adapted to be removably or non-removably mounted to the open end of a container. Alternatively, the dispensing structure may be formed as a unitary part, or extension, of the container.

In a further preferred form of the invention, the dispensing structure is molded from a thermoplastic material, and the body of the structure includes a strut for extending over the container opening to define two equal half access apertures and to function as a scraper for leveling a spoon full of the product.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

FIG. 4 is a view similar to FIG. 3, but FIG. 4 shows the foraminous member of the closure in an open orientation;

FIG. 5 is a fragmentary, cross-sectional view taken generally along the plane line 5—5 in FIG. 2; and FIG. 6 is a fragmentary, perspective view, similar to FIG. 4, and FIG. 6 shows product being withdrawn in a spoon through the closure opening.

DESCRIPTION OF THE PREFERRED EMBODIMENT

While this invention is susceptible of embodiment in many different forms, this specification and the accompanying drawings disclose only one specific form as an example of the invention. The invention is not intended to be limited to the embodiment so described, however. The scope of the invention is pointed out in the appended claims.

For ease of description, the dispensing structure of this invention is described in the normal (upright) operating position, and terms such as upper, lower, horizontal, etc., are used with reference to this position. It will be understood, however, that the dispensing structure of this invention may be manufactured, stored, transported, used, and sold in an orientation other than the position described.

Figure 1:
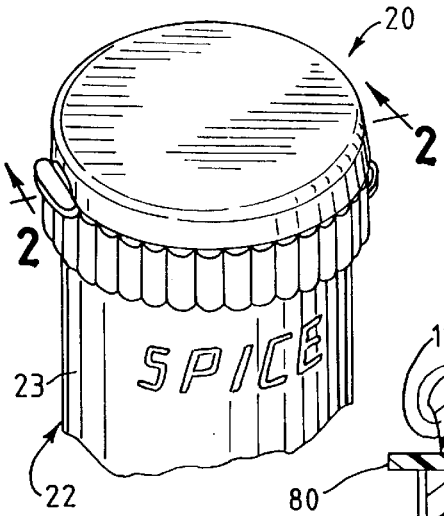
FIG. 1 is a perspective view of a preferred embodiment of a dispensing structure of the present invention in the form of a closure removably mounted on a container.
Figure 2:
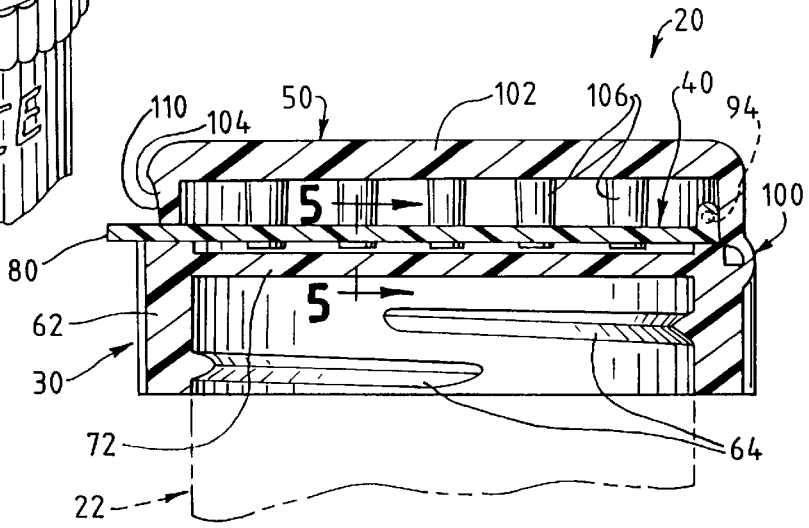
FIG. 2 is an enlarged, cross-sectional view taken generally along the plane 2—2 in FIG. 1.

A presently preferred embodiment of a dispensing structure or system of the present invention is illustrated in FIGS. 1–6 and is designated generally therein by reference number 20. In the preferred embodiment illustrated, the dispensing structure is provided in the form of a closure 20 which is adapted to be mounted on a container 22 (FIGS. 1 and 2). The body of the container 22 may have a suitable configuration with an upwardly projecting neck 23 which may have a different cross-sectional shape than the container body.

The container 22 would typically contain a powdered material, granular material, shredded material, or other particulate material (e.g., a ground up spice used for food preparation). Such a particulate material is designated generally by the reference number 25 in FIG. 6.

The container 22 may have a rigid wall or walls or may have a somewhat flexible wall or walls. The container 22 defines an opening, typically at the upper end of the container neck 23 (if the container has such a neck).

Although the container, per se, need not necessarily form a part of the present invention, per se, it will be appreciated that the dispensing structure or system of the present invention may be provided as a unitary portion, or extension, of the top of the container 22. However, in the preferred embodiment illustrated, the dispensing structure 20 is a separate element or closure which is adapted to be mounted to a previously manufactured container 22 which has an opening to the container interior.

As shown in FIG. 5, the preferred embodiment closure or dispensing structure 20 of the present invention includes a base portion or body 30, a foraminous member 40, and a lid 50. Preferably, the foraminous member 40 and lid 50 are each hingedly connected to the body 30 by means described in detail hereinafter. This accommodates movement of the lid from a closed position (FIG. 1) to an open position (FIG. 4) while maintaining the lid 50 attached to the body 30, and this also permits movement of the foraminous member 40 from a closed position (FIG. 3) to an open position (FIG. 4) while maintaining connection of the foraminous member 40 to the body 30.

As illustrated in FIG. 2, in the preferred embodiment of the dispensing structure 20 the body 30 may be characterized as having or defining a skirt 62 for receiving the upper end of the container 22. The skirt 62 includes suitable connecting means, such as a conventional thread 64 adapted to be threadingly engaged with a mating container thread (not illustrated). The closure body 30 and container 22 could also be attached with either a dual snap-fit bead engagement or a mating bead and groove engagement.

Also, the closure body 30 could be permanently fixed to the container 22 by means of induction melting, ultrasonic melting, gluing, or the like, depending upon the materials used for the closure body 30 and container 22.

As previously mentioned, the closure body could also be formed as a unitary part, or extension, of the container 22.

As illustrated in FIG. 4, the top of the closure body 30 defines a peripheral deck 66, at least a portion of which functions as a support surface 68 at a location that may be characterized as the front of the structure. A collar or ring 70 extends upwardly from the deck 66 except in the small region of the support surface 68. A bar or strut 72 extends across a diameter of the closure body 30 to define two equal half access apertures 74. In an alternate embodiment, the strut 72 need not extend across the diameter, and the size and shape of the access apertures need not be the same. Further, in another alternate embodiment, the strut 72 may be eliminated altogether.

Figure 3:
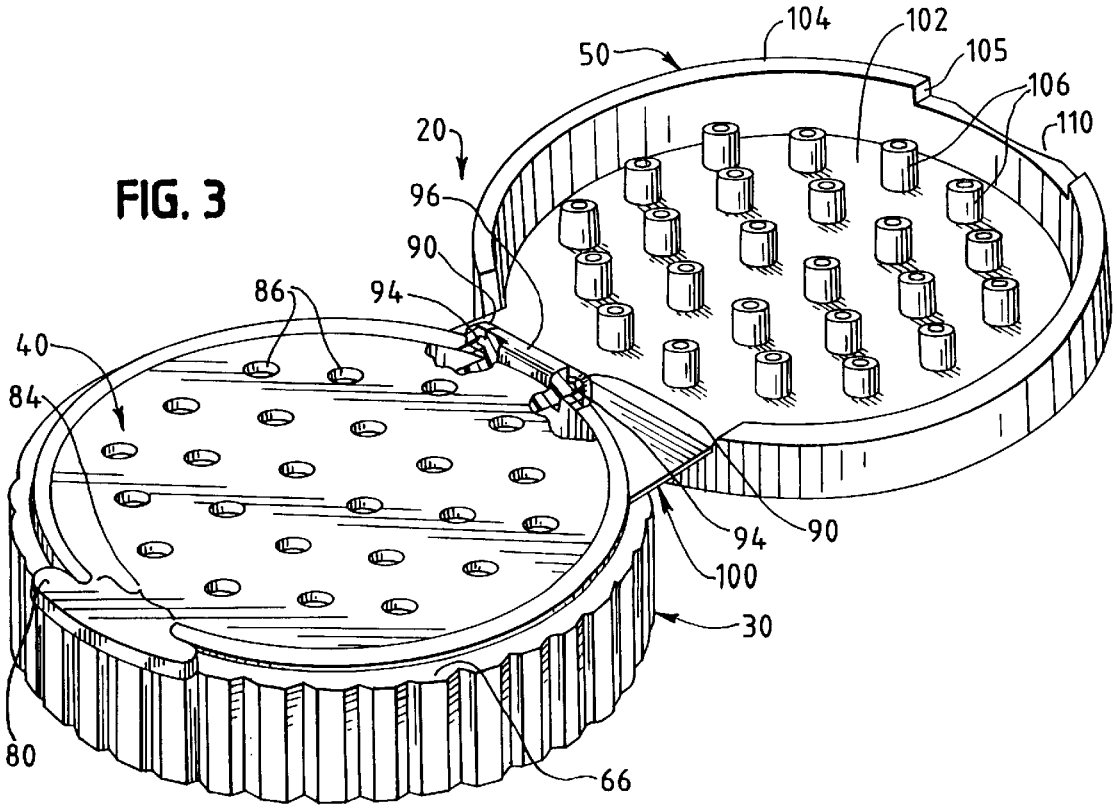
FIG. 3 is a perspective view of the dispensing structure or closure shown in the open position with the container omitted and with portions of the structure broken away to show interior details.

The foraminous member 40 is a substantially plate-like member having a generally circular configuration with an outwardly projecting finger tab or lift tab 80. The lower surface of the lift tab 80 is adapted to rest on the support surface 68 defined at the front portion of the deck 66 of the body 30. As shown in FIG. 2, when the foraminous member 40 is in the lowered (closed) position, the lower surface of the foraminous member 40 is spaced slightly above the top of the strut 72. The foraminous member tab 80 includes a reduced width portion 84 which is just slightly wider than the narrowest part of the support surface 68 defined between the two halves of the ring 70 so as to create an interference friction fit when the foraminous member 40 is in a lowered, closed position (FIG. 3). This holds the foraminous member 40 in the closed position when the container 22 is inverted while the lid 50 is open.

The foraminous member 40 also defines a plurality of sprinkling holes or dispensing holes 86 through which the container contents can be sprinkled when the container is inverted with the lid 50 open. In the preferred embodiment illustrated, each of the holes 86 is a generally circular or cylindrical bore having the same diameter, and the holes 86 are distributed in a generally uniform array across the foraminous member 40. The size and shape and number of the dispensing holes 86 may be varied depending upon the material to be dispensed from the container.

Preferably, the foraminous member 40 is connected with a hinge to the closure body 30 at a location diametrically opposite the tab 80. To this end, the closure body 30 defines a pair of spaced-apart tabs 90 (FIG. 4). Each tab 90 projects upwardly above the ring 70 and defines a journal-bearing cavity for receiving a stub shaft 94 projecting laterally from a rib 96 at the rear of the foraminous member 40. The stub shafts 94 are preferably received within the journal cavities of the tabs 90 in a snap-fit engagement to accommodate ease of assembly. However, it will be appreciated that other types of hinge structures may be employed, including unitary molded living hinge structures.

Further, in yet another embodiment of the invention, a hinge connection between the foraminous member 40 and closure body 30 may be omitted altogether. That is, the foraminous member 40 may be completely removable from the closure body 30.

The lid 50 may also be completely separate from the closure body 30. However, preferably the lid 50 is connected to the closure body 30 with a suitable hinge. One preferred hinge is the snap-action hinge 100 disclosed in the U.S. Pat. No. 5,642,824. Preferably, such a snap-action hinge 100 provides a bi-stable action for maintaining the lid in a substantially closed position (FIG. 2) or in a substantially open position (FIGS. 3 and 5). The hinge 100 is preferably located diametrically opposite the tab 80 on the foraminous member 40.

The lid 50 includes a generally circular, planar, disk portion 102 surrounded by a peripheral skirt 104. The skirt 104 is adapted to seat on the body deck 66 outwardly of the ring 70. The front of the lid 50 defines a notch 105 to accommodate the foraminous member tab 80 when the lid 50 is closed.

Preferably, the lid 50 includes a plurality of protrusions 106. Each protrusion 106 is configured to be received in a dispensing hole 86 of the foraminous member 40 so as to sealingly occlude that dispensing hole 86. Preferably, the protrusion 106 extends through the associated dispensing hole 86 so as to clean out each hole when the lid 50 is closed and so as to prevent each hole 86 from becoming plugged up with the material in the container. If the dispensing holes 86 are substantially circular or cylindrical apertures as illustrated in the preferred embodiment, then each protrusion 106 is preferably a generally cylindrical projection. However, in some applications, it may be desirable for at least a distal end portion of each protrusion 106 to define a slightly tapered or frustoconical configuration for easily entering the associated dispensing hole 86 in the foraminous member 40. Each protrusion 106 may be solid or hollow.

The dispensing structure 20 is easily used. Typically, the dispensing structure 20 is encountered by a consumer in an initially closed condition on a container 22 as illustrated in FIGS. 1 and 2. The consumer may initially lift the lid by applying an upward force with a finger or thumb to the front of the lid 50. This may be facilitated if the front of the lid 50 defines a concave finger surface or thumb-engaging surface 110 (FIGS. 2 and 3).

The lid 50 can be opened to a fully open position (substantially 180 degrees from the closed position) as shown in FIG. 3 so as to expose the foraminous member 40. The container may then be inverted, and the container contents sprinkled out through the dispensing holes 86 of the foraminous member 40. Alternatively, or subsequently, the consumer may lift the foraminous member 40 by pushing upwardly on the finger tab 80. The foraminous member 40 may be pushed to an open position away from the closed position.

The foraminous member need not be moved all the way to an orientation 180 degrees from the closed position. Instead, the foraminous member 40 might be swung through a much smaller arc, say 80 degrees or 90 degrees or 120 degrees (FIG. 5). Depending upon the nature of the hinge structure connecting the foraminous member 40 to the closure body 30, there may be sufficient friction, or other position retention effects, to maintain the foraminous member 40 in the open position without requiring that the consumer continue to hold the foraminous member 40. Of course, if a very loose hinge connection is employed between the foraminous member 40 and the closure body 30, then the foraminous member 40 can be swung to a substantially fully open position equal to or greater than 180 degrees from the closed position where it will be maintained in that position by gravity so long as the container is oriented generally upright. In some applications, there may be no hinge connection between the foraminous member 40 and the closure body 30. With such a design, the foraminous member 40 would be lifted completely off of the closure body and temporarily held by the consumer or placed on a support surface.

In any event, after the foraminous member 40 has been moved sufficiently away from its closed position, the container contents can be accessed through either or both of the two access apertures 74. Typically, a spoon 120 (FIG. 6) is inserted through one of the access apertures 74 into the container. A spoonful of the material 25 within the container is lifted up against the strut 72 so as to level the spoon and provide a measured spoonful of the material. If desired, the container could be inverted so as to pour some or all of the contents from the container through one or both of the access apertures 74.

After the desired amount of material has been removed from the container, the foraminous member 40 can be repositioned to its seated, closed position (FIG. 3), and then the lid 50 can be returned to its closed position (FIGS. 1 and 2). When the lid 50 is returned to its closed position, the protrusions 106 penetrate the dispensing holes 86 to clean out any holes that may have been plugged with material and to prevent the holes from thereafter becoming plugged with material until the closure is subsequently opened.

In some applications involving some kinds of material, there may be no likelihood that the dispensing holes 86 could become plugged with material. In such applications, it would not be necessary to provide the protrusions 106 in the lid 50. The disk portion 102 of the lid 50 could instead be configured to seal flat across the tops of the holes 86. This would reduce the complexity and expense of manufacture.

It is presently contemplated that many applications employing the dispensing structure 20 will be most conveniently realized by molding the dispensing structure 20 from suitable thermoplastic material or materials. In the preferred embodiment illustrated, the body 30, hinge 100, and lid 50 could be molded as a unitary structure from a suitable thermoplastic material, such as polypropylene. The foraminous member 40 may be separately molded from the same material or from a different material. The foraminous member 40 may be conveniently molded from a material that is a different color than the color of the body 30 and lid 50.

It will also be appreciated that retention structures, other than that illustrated, may be provided for releasably retaining the foraminous member 40 in the seated or closed position (FIGS. 2 and 3). Further, suitable interference-fit structures or latch structures of a conventional or non-conventional design may be provided for releasably retaining the lid 50 in the closed position (FIGS. 1 and 2). Such conventional lid-retention structures can include a suitable interference fit or a snap-fit engagement between very small ribs (not illustrated) on the lid and body or a snap-fit engagement between a very small rib on the lid and a mating groove on the body or vice versa (not illustrated).

It will also be appreciated that the dispensing structure 20 can be readily designed to incorporate appropriate tamper-evident features and/or child-resistant features. Such features may be incorporated within the structure of the closure body and lid and/or may include overcap structures or shrink film systems (not illustrated).

It will be readily apparent from the foregoing detailed description of the invention and from the illustrations thereof that numerous variations and modifications may be effected without departing from the true spirit and scope of the novel concepts or principles of this invention.

What is claimed is:

1. A dispensing structure for a container that has an opening to the container interior, said dispensing structure comprising:

a body for extending around said container opening, said body including a generally linear strut for extending between two ends of said strut over said container opening to define two, substantially equal half access apertures and to function as a scraper for leveling a spoon full of a product from said container, said body defining a support surface around at least a portion of said access apertures;

a foraminous member defining a plurality of dispensing holes;

a first hinge connecting said foraminous member to said body adjacent one of said strut ends to accommodate pivoting movement of said foraminous member about an axis generally perpendicular to said strut between (1) a closed position supported on said body support surface over said container opening for facilitating sprinkling of a product from said container, and (2) an open position away from said closed position to permit access to the container interior;

a lid with a plurality of protrusions that each correspond to, and are adapted to sealingly occlude, one of said foraminous member holes; and a second hinge connecting said lid to said body adjacent said first hinge to accommodate pivoting movement of said lid about an axis generally Perpendicular to said strut between (1) a closed position over both said container opening and said foraminous member when said foraminous member is in its closed position whereby said protrusions are received in said corresponding foraminous member holes to sealingly occlude said holes, and (2) an open position away from said lid closed position to permit lifting of said foraminous member.

2. The dispensing structure in accordance with claim 1 in which said dispensing structure is a closure for an end of said container which defines said opening.

3. The dispensing structure in accordance with claim 2 in which said closure is an article formed separately from said container; and said body is removably attachable to said container end.

4. The dispensing structure in accordance with claim 2 in which said closure is a unitary part of said container, and said body extends from said container as a unitary part of said container end.

5. The dispensing structure in accordance with claim 1 in which said body has a generally circular periphery.

6. The dispensing structure in accordance with claim 1 in which said foraminous member is a generally disc-shaped plate.

7. The dispensing structure in accordance with claim 1 in which said foraminous member is generally circular and has a lift tab extending outwardly of said body at a location diametrically opposite from said first hinge.

8. The dispensing structure in accordance with claim 1 in which said first hinge includes a stub shaft on an edge of said foraminous member and a receiving journal bearing on said body for receiving said stub shaft.

9. The dispensing structure in accordance with claim 1 in which said second hinge is a bi-stable, snap-action hinge.

10. A dispensing structure for a container that has an opening to the container interior, said dispensing structure comprising:

a body for extending around said container opening, said body defining a support surface;

a foraminous member defining a plurality of dispensing holes;

a first hinge connecting said foraminous member to said body to accommodate movement of said foraminous member between (1) a closed position supported on said body support surface over said container opening for facilitating sprinkling of a product from said container, and (2) an open position away from said closed position to permit access to the container interior, said first hinge including a stub shaft adjacent an edge of said foraminous member and a receiving journal bearing on said body for receiving said stub shaft to mount said foraminous member to said body in a snap-fit engagement;

a lid molded from thermoplastic material unitary with said body, said lid having a plurality of protrusions that each correspond to, and are adapted to sealingly occlude, one of said foraminous member holes, each said protrusion having a hollow interior; and a second hinge connecting said lid to said body to accommodate movement of said lid between (1) a closed position over both said container opening and said foraminous member when said foraminous member is in its closed position whereby said protrusions are received in said corresponding foraminous member holes to sealingly occlude said holes, and (2) an open position away from said lid closed position to permit lifting of said foraminous member.

11. The dispensing structure in accordance with claim 10 in which said dispensing structure is a closure for an end of said container which defines said opening.

12. The dispensing structure in accordance with claim 11 in which said body is removably attachable to said container end.

13. The dispensing structure in accordance with claim 11 in which said closure body is a unitary part of said container, and said body extends from said container as a unitary part of said container end.

14. The dispensing structure in accordance with claim 10 in which said body includes a strut for extending over said container opening to define two, substantially equal half access apertures and to function as a scraper for leveling a spoon full of said product.

15. The dispensing structure in accordance with claim 10 in which said body has a generally circular periphery.

16. The dispensing structure in accordance with claim 10 in which said foraminous member is a generally disc-shaped plate.

17. The dispensing structure in accordance with claim 10 in which said foraminous member is generally circular and has a lift tab extending outwardly of said body at a location diametrically opposite from said first hinge.

18. The dispensing structure in accordance with claim 10 in which said second hinge is a bi-stable, snap-action hinge.

19. A dispensing structure for a container that has an opening to the container interior, said dispensing structure comprising:

a body for extending around said container opening, said body defining a support surface;

a foraminous member defining a plurality of dispensing holes;

a first hinge connecting said foraminous member to said body to accommodate movement of said foraminous member between (1) a closed position supported on said body support surface over said container opening for facilitating sprinkling of a product from said container, and (2) an open position away from said closed position to permit access to the container interior, said first hinge including a stub shaft adjacent an edge of said foraminous member and a receiving journal bearing on said body for receiving said stub shaft to mount said foraminous member to said body in a snap-fit engagement;

a lid molded from thermoplastic material unitary with said body to sealingly occlude said foraminous member holes; and a second hinge connecting said lid to said body to accommodate movement of said lid between (1) a closed position over both said container opening and said foraminous member when said foraminous member is in its closed position whereby said protrusions are received in said corresponding foraminous member holes to sealingly occlude said holes, and (2) an open position away from said lid closed position to permit lifting of said foraminous member.

* * * * *